US007093374B2

(12) United States Patent
Yang et al.

(10) Patent No.: US 7,093,374 B2
(45) Date of Patent: Aug. 22, 2006

(54) CLOTHES DRYER AND METHOD OF CONTROLLING THE SAME

(75) Inventors: Byoung Yull Yang, Ansan (KR); Hyung-Gyoon Kim, Suwon (KR); Sang-Yeon Pyo, Suwon (KR); Seon-Woo Park, Suwon (KR); Hye Soon Yang, Yongin (KR); Seong Min Oak, Masan (KR); Jae-Ryong Park, Suwon (KR); Hyun Sook Kim, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/790,781

(22) Filed: Mar. 3, 2004

(65) Prior Publication Data

US 2005/0016012 A1 Jan. 27, 2005

(30) Foreign Application Priority Data

Jul. 21, 2003 (KR) ..... 10-2003-0049659

(51) Int. Cl.
*F26B 21/08* (2006.01)
*F26B 21/10* (2006.01)

(52) U.S. Cl. ..... 34/60; 34/595; 34/606; 34/607; 34/608; 34/82; 34/528; 34/549; 34/557; 34/202

(58) Field of Classification Search ..... 34/130, 34/131, 132, 595, 596, 604, 605, 606, 607, 34/608, 134, 139, 82, 528, 549, 557, 202, 34/260, 92, 60

See application file for complete search history.

(56) References Cited

U.S. PATENT DOCUMENTS

| | | | | | |
|---|---|---|---|---|---|
| 2,406,494 | A * | 8/1946 | Ferris | 34/60 |
| 2,741,856 | A * | 4/1956 | Hall | 34/555 |
| 4,621,438 | A * | 11/1986 | Lanciaux | 34/77 |
| 4,625,432 | A * | 12/1986 | Baltes | 34/621 |
| 4,908,959 | A | 3/1990 | Kretchman et al. | |
| 5,546,678 | A * | 8/1996 | Dhaemers | 34/275 |
| 5,555,640 | A * | 9/1996 | Ou | 34/202 |
| 5,578,753 | A * | 11/1996 | Weiss et al. | 73/335.02 |
| 5,755,040 | A * | 5/1998 | Ou | 34/202 |
| 5,940,988 | A * | 8/1999 | Eisen | 34/596 |
| 6,312,507 | B1 * | 11/2001 | Taylor et al. | 96/19 |
| 6,447,731 | B1 * | 9/2002 | Sun et al. | 422/121 |
| 2003/0126691 | A1 * | 7/2003 | Gerlach et al. | 8/158 |

FOREIGN PATENT DOCUMENTS

| | | | |
|---|---|---|---|
| JP | 02087175 | A * | 3/1990 |
| JP | 2002085898 | A * | 3/2002 |
| JP | 2002282346 | A * | 10/2002 |

* cited by examiner

*Primary Examiner*—Jiping Lu
(74) *Attorney, Agent, or Firm*—Staas & Halsey LLP

(57) ABSTRACT

A clothes dryer and a method of controlling the clothes dryer. The method detects conditions of clothes using a sensor, and performs at least one of: a complex drying function to perform a drying operation, a deodorizing operation, and a wrinkle removing operation; a wrinkle removing function to perform the wrinkle removing operation and the drying operation; and a drying function to perform the drying operation, according to the detected conditions of the clothes. Accordingly, the clothes dryer is capable of not only drying the clothes, but also deodorizing the clothes and removing wrinkles. Additionally, the clothes dryer is capable of detecting conditions of clothes accommodated in a chamber, and drying and deodorizing the clothes as occasion demands, thus maintaining the clothes for a long period.

13 Claims, 5 Drawing Sheets

CLOTHES DRYER AND METHOD OF CONTROLLING THE SAME

CROSS-REFERENCE TO RELATED APPLICATIONS

This application claims the benefit of Korean Application No. 2003-49659, filed Jul. 21, 2003, in the Korean Intellectual Property Office, the disclosure of which is incorporated herein by reference.

BACKGROUND OF THE INVENTION

1. Field of the Invention

The present invention relates generally to clothes dryers, and more particularly, to a clothes dryer, and a method of controlling the clothes dryer, which dries clothes by supplying a current of warm air to a chamber accommodating the clothes.

2. Description of the Related Art

Conventional clothes dryers are apparatuses that dry clothes by forcibly blowing air, heated by an electric heater, to washed clothes after most of water has been removed from the washed clothes by spin-drying the washed clothes. One type of conventional clothes dryer is a drum-type clothes dryer, in which a large quantity of wet clothes are put into a rotating drum, and the wet clothes are dried while the clothes are rotated.

But, when the clothes are dried using the conventional drum-type clothes dryer, many wrinkles are formed, which causes an inconvenience, in that ironing has to follow the drying. In particularly, since the clothes dried by the drum-type clothes dryer have more wrinkles than clothes dried naturally, it is difficult, and takes a long period of time to iron the dried clothes. Furthermore, since the conventional drum-type clothes dryer is manufactured to dry a large quantity of clothes, sterilization of various kinds of harmful bacteria residing in the clothes, or deodorization of the clothes, may not occur. Additionally, the conventional drum-type clothes dryer has a limitation in that the conventional drum-type clothes dryer is used only as a clothes dryer.

SUMMARY OF THE INVENTION

Accordingly, the present invention has been made keeping in mind the above problems occurring in the related art, and it is an aspect of the present invention to provide a clothes dryer, and a method of controlling the clothes dryer, which are capable of not only drying the clothes, but also deodorizing the clothes and removing wrinkles.

It is another aspect of the present invention to provide a clothes dryer, and method of controlling the clothes dryer, which are capable of detecting conditions of clothes accommodated in a chamber, and drying and deodorizing the clothes as occasion demands, so that the clothes may be maintained in a ready-to-wear state for a long period.

Additional aspects and/or advantages of the invention will be set forth in part in the description which follows and, in part, will be obvious from the description, or may be learned by practice of the invention.

The above and/or other aspects are achieved by providing a clothes dryer, including a chamber to accommodate clothes, a heater to generate a current of warm air by heating air supplied to the chamber, an ozonizer to supply ozone into the chamber, and a control unit to control the heater to dry the clothes using the current of warm air, and to control the ozonizer to remove odor from the clothes using the ozone.

The above and/or other aspects are achieved by providing a clothes dryer, including a chamber to accommodate clothes, a humidifier to supply moisture into the chamber, a heater to generate a current of warm air by heating air supplied to the chamber, and a control unit to control the humidifier to supply the moisture to the clothes, and to control the heater to simultaneously dry the clothes and remove wrinkles from the clothes using the current of warm air.

The above and/or other aspects are achieved by providing a method of controlling a clothes dryer, the method including detecting conditions of the clothes using a sensor, and performing at least one of a complex drying function to perform a drying operation, a deodorizing operation and a wrinkle removing operation, a wrinkle removing function to perform the wrinkle removing operation and the drying operation, and a drying function to perform the drying operation, according to the detected conditions of the clothes.

The above and/or other aspects are achieved by providing a method of controlling a clothes dryer, the clothes dryer having an input unit by which a user selects an operation mode of the clothes dryer, the method including receiving information about the operation mode selected by the user through the input unit, and performing at least one of a complex drying function to perform a drying operation, a deodorizing operation and a wrinkle removing operation, a wrinkle removing function to perform the wrinkle removing operation, and the drying operation, and a drying function to perform the drying operation, according to the received information about the operation mode.

The above and/or other aspects are achieved by providing a method of controlling a clothes dryer, including removing odor from the clothes, supplying moisture to the clothes, and collectively performing wrinkle removal and drying of the clothes by drying the clothes containing the moisture.

The above and/or other aspects are achieved by providing a clothes dryer, including a chamber to accommodate clothes, a first duct to supply air of first pressure into the chamber, a second duct to supply air of second pressure into the chamber, a heater to heat air supplied through at least one of the first and second ducts, and an ozonizer to supply ozone into the chamber through at least one of the first and second ducts.

The above and/or other aspects are achieved by providing an apparatus for containing clothes, the apparatus including a chamber to accommodate clothes, a heater to generate a current of warm air by heating air supplied into the chamber, an ozonizer to supply ozone into the chamber, and a control unit to control the heater and/or the ozonizer to periodically perform a drying function and/or a deodorizing function according to amounts of moisture and/or odor of the clothes.

BRIEF DESCRIPTION OF THE DRAWINGS

The above and/or other aspects and advantages of the invention will become apparent and more readily appreciated from the following description of the embodiment, taken in conjunction with the accompanying drawings, in which.

DETAILED DESCRIPTION

Figure 1:
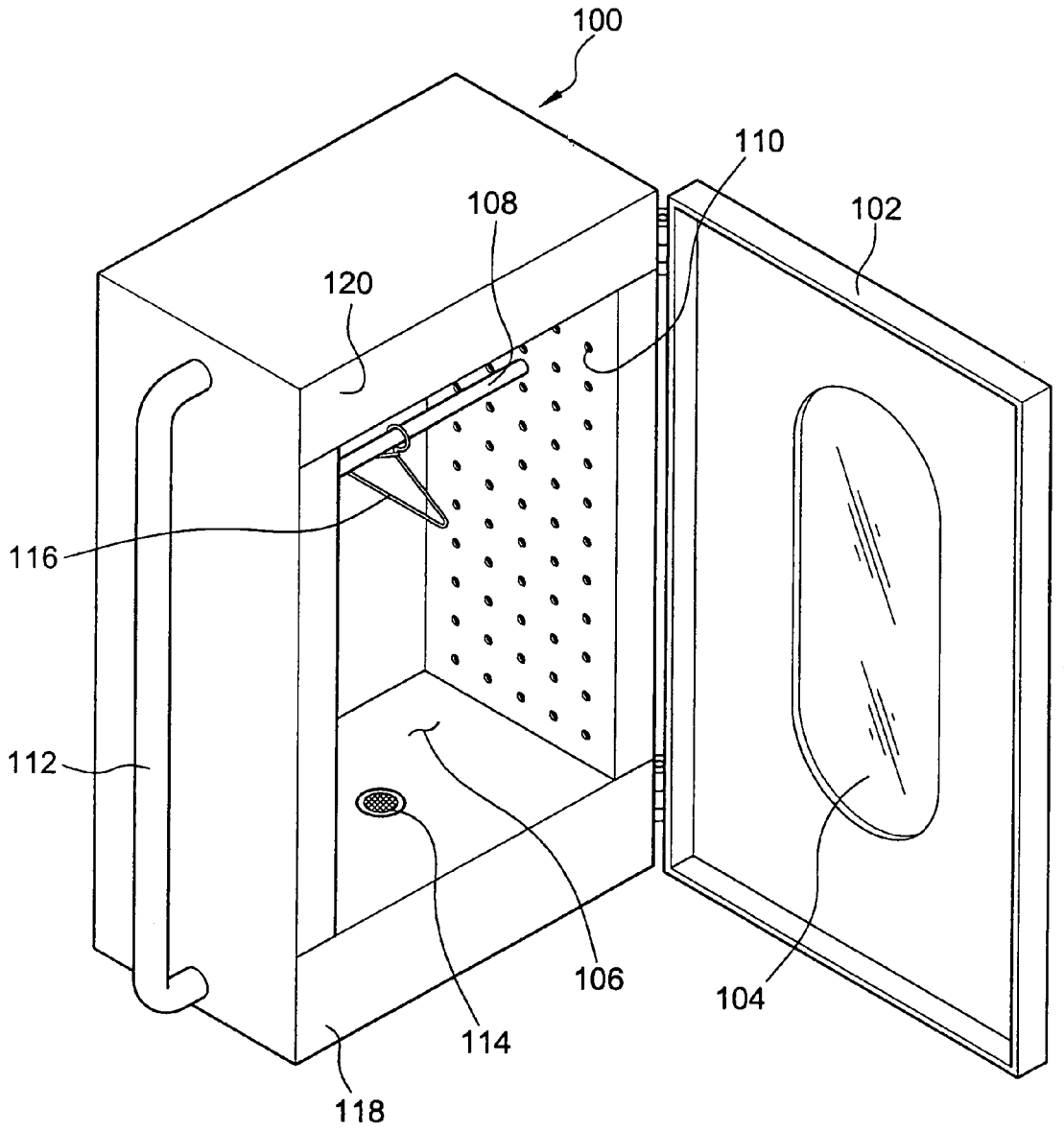
FIG. 1 is a perspective view of a clothes dryer, according to an embodiment of the present invention.

Reference will now be made in detail to the embodiment of the present invention, an example of which is illustrated in the accompanying drawings, wherein like reference numerals refer to the like elements throughout. The embodiment is described below to explain the present invention by referring to the figures.

FIG. 1 is a perspective view of a clothes dryer, according to ah embodiment of the present invention. As shown in FIG. 1, the clothes dryer 100 includes a chamber 106 to accommodate clothes. A rod 108 is horizontally provided across an upper portion of the chamber 106, to suspend the clothes using hooks 116 hooked thereon. A plurality of vents 110 are positioned in side walls of the chamber 106. The plurality of vents 110 communicate with internal ducts (see reference numeral 302 of FIG. 3) that will be described later.

With this structure, air supplied through the internal ducts 302 is supplied into the chamber 106 through the plurality of vents 110 positioned in the side walls. A filter 114 is provided in a bottom of the chamber 106, to filter out impurities separated from the clothes inside the chamber 106. An upper machine room 120 and a lower machine room 118, which are provided on two portions above and below the chamber 106, respectively, communicate with each other via an external duct 112. The lower and upper machine rooms 118 and 120 include devices required to dry and deodorize the clothes, and to remove wrinkles from the clothes, a control unit, and a circuit board (see FIG. 3). A door 102 to open and close the chamber 106 includes a transparent member 104. A user can observe an internal state of the chamber 106 directly through the transparent member 104.

Figure 2:
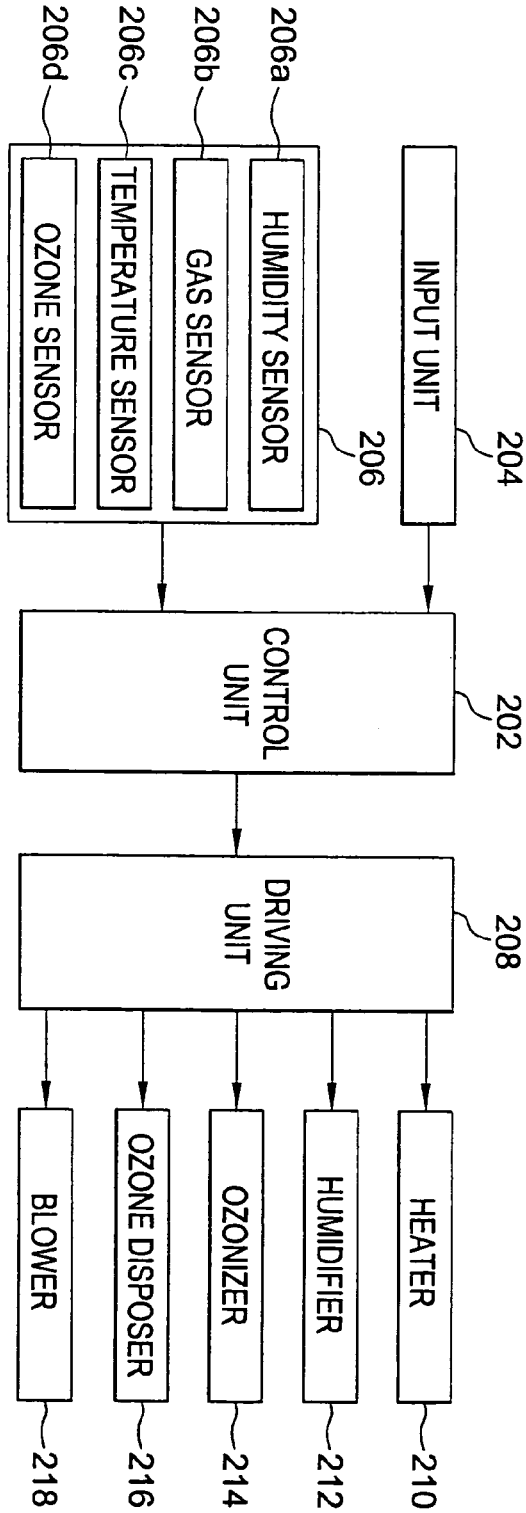
FIG. 2 is a block diagram of a control system of the clothes dryer of FIG. 1.

FIG. 2 is a block diagram of a control system of the clothes dryer of FIG. 1. As shown in FIG. 1, an input unit 204 and a sensor unit 206 are connected to an input port of a control unit 202, that controls an overall operation of the clothes dryer 100. The input unit 204 allows the user to select an operation mode of the clothes dryer, and to input set values to the clothes dryer 100. The control unit 202 receives information of the operation mode or information of the set value from the input unit 204, and controls the clothes dryer 100 according to the information.

The sensor unit 206 includes a humidity sensor 206*a*, a gas sensor 206*b*, a temperature sensor 206*c*, and an ozone sensor 206*d*. The humidity sensor 206*a* detects an amount of moisture in the chamber 106. The control unit 202 determines an amount of moisture contained in the clothes based on a detection result of the humidity sensor 206*a*. The gas sensor 206*b* is used to detect an extent of odor of the clothes in the chamber 106, and detects an amount of particular odor of the clothes in the chamber 106. The control unit 202 determines a kind and extent of the odor of the clothes based on a detection result of the gas sensor 206*b*. The temperature sensor 206*c* detects internal temperature of the chamber 106. The ozone sensor 206*d* detects an amount of ozone contained in air inside the chamber 106. The sensors 206*a* to 206*d* provided in the clothes dryer 100 of the present invention may be installed in any locations in the clothes dryer 100, but only if they can still detect the objects they are intended to detect.

An output port of the control unit 202 is connected to a driving unit 208, which in turn is connected to a heater 210, a humidifier 212, an ozonizer 214, an ozone disposer 216, and a blower 218. The heater 210 dries the clothes by heating air supplied to the chamber 106, and thereby generating warm air. The humidifier 212 supplies moisture into the chamber. The clothes contain the moisture through supply of the moisture into the chamber 106 using the humidifier 212. When the clothes containing moisture are dried by the current of warm air, wrinkles are removed from the clothes. The ozonizer 214 is used to generate ozone, and may effectively deodorize the clothes by generating ozone and supplying the ozone to the chamber 106. The ozone disposer 216 removes ozone remaining in the chamber 106 after the deodorization of the clothes has been completed. The blower 218 selectively blows relatively high and low pressure air into the chamber 106.

Figure 3:
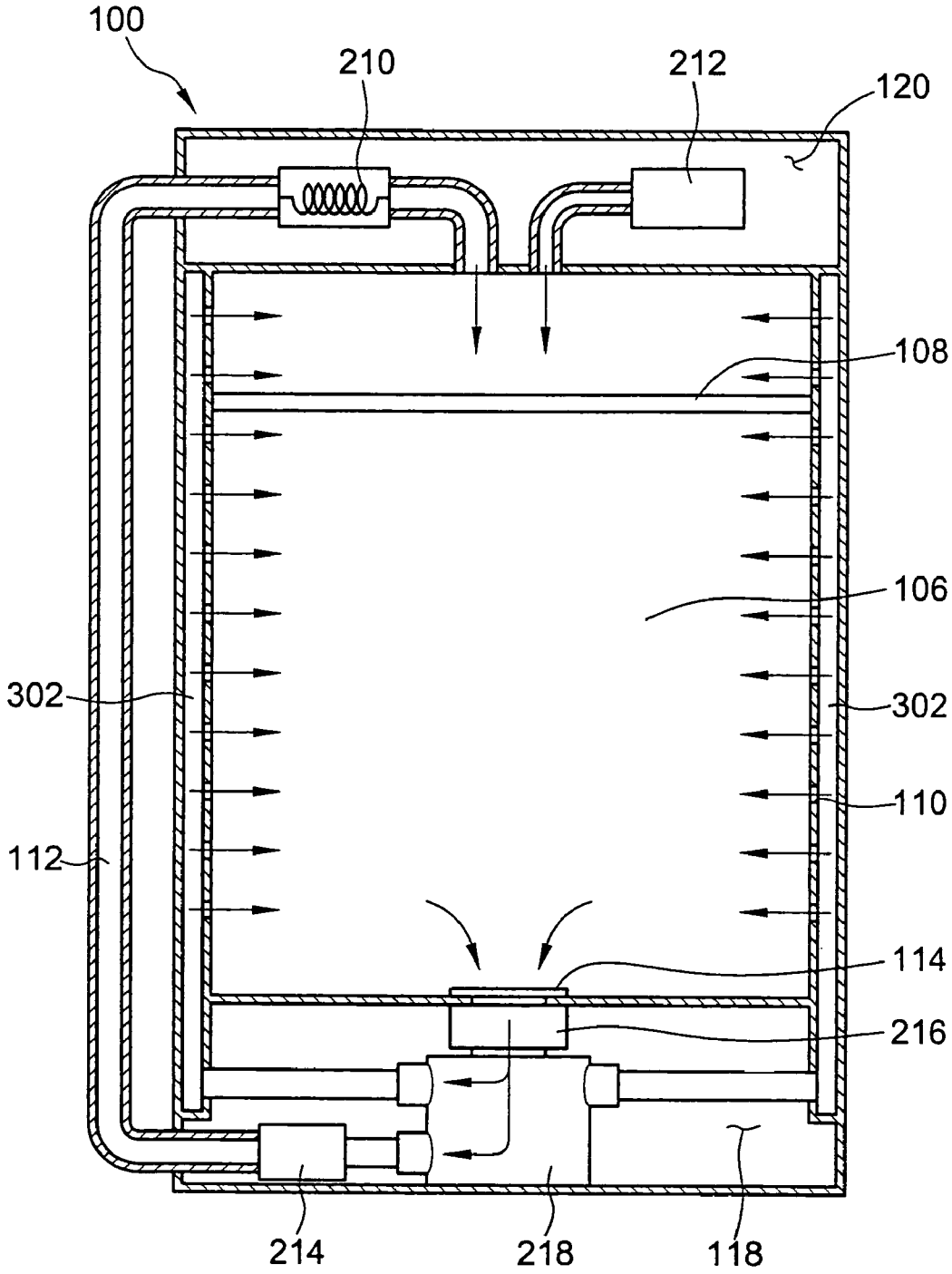
FIG. 3 is a sectional view of the clothes dryer of FIG. 1.

FIG. 3 is a sectional view of the clothes dryer of FIG. 1. As shown in FIG. 3, the lower machine room 118 provided on the portion below the chamber 106 includes the blower 218, the ozonizer 214, and the ozone disposer 216. The upper machine room 120 provided on the portion above the chamber 106 includes the heater 210 and the humidifier 212.

The blower 218 selectively generates relatively high and low air pressure by drawing and compressing internal air of the chamber 106. The high-pressure compressed air generated by the blower 218 is supplied to the chamber through the plurality of vents 110, while moving along the internal ducts 302 positioned on both side walls of the chamber 106. The high-pressure compressed air creates a strong current of air around the clothes accommodated in the chamber 106, to uniformly spread odor and moisture contained in the clothes throughout an internal space of the chamber 106. The low-pressure compressed air discharged from the blower 218 is supplied to an upper portion of the chamber 106 through the external duct 112. The external duct 112 is provided with the ozonizer 214 and the heater 210 therein. When the ozonizer 214 is operated, ozone is supplied into the chamber 106 through the external duct 112. When the heater 210 is operated, the current of warm air is supplied into the chamber 106 through the external duct 112. The humidifier 212 generates moisture and supplies the moisture into the chamber 106. The ozone disposer 216 is positioned on a drawing side of the blower 218, and removes ozone from air drawn from the chamber 106 into the blower 218.

Figure 4:
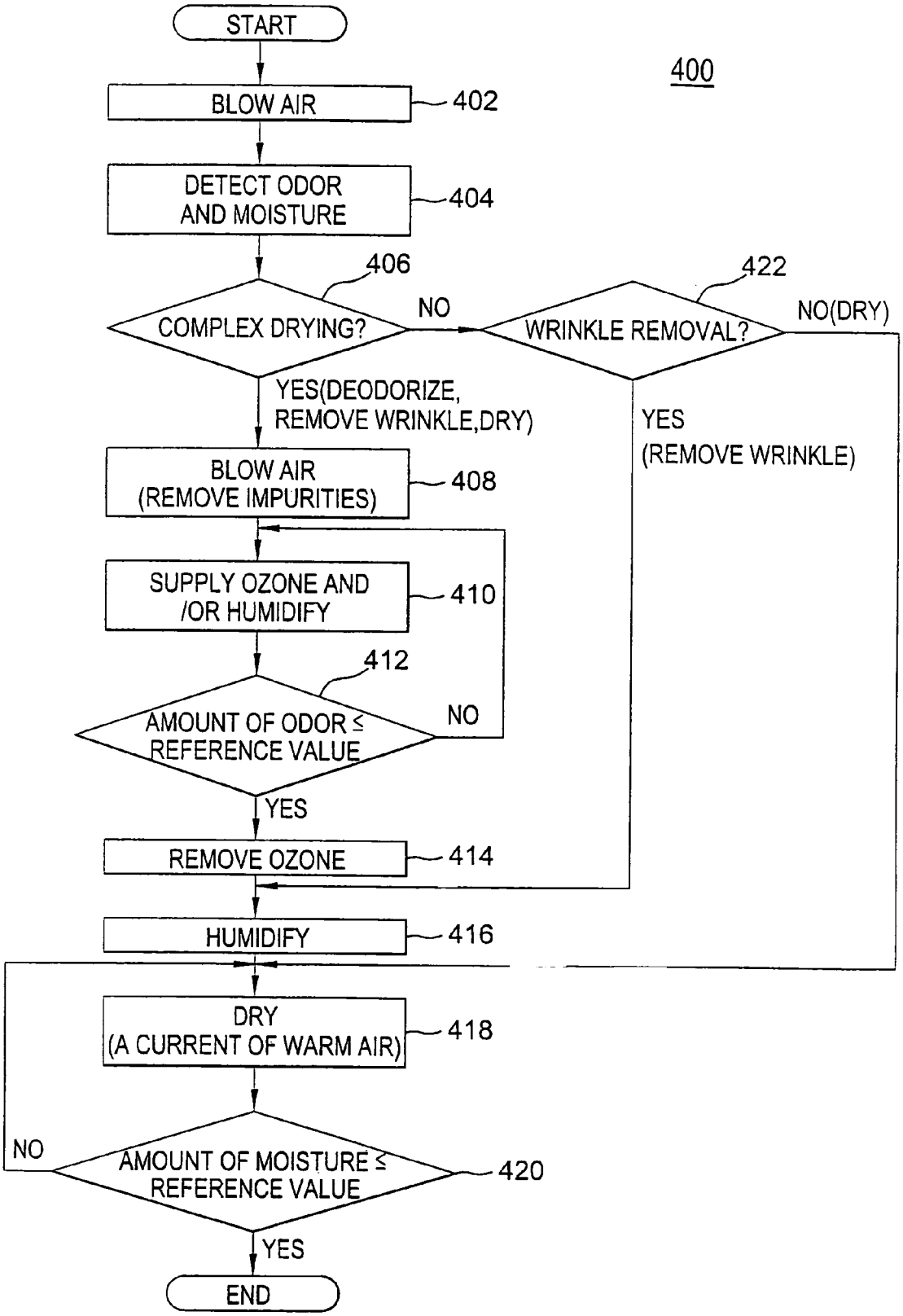
FIGS. 4 and 5 are flow charts showing a method of controlling the clothes dryer of FIG. 1.
Figure 5:
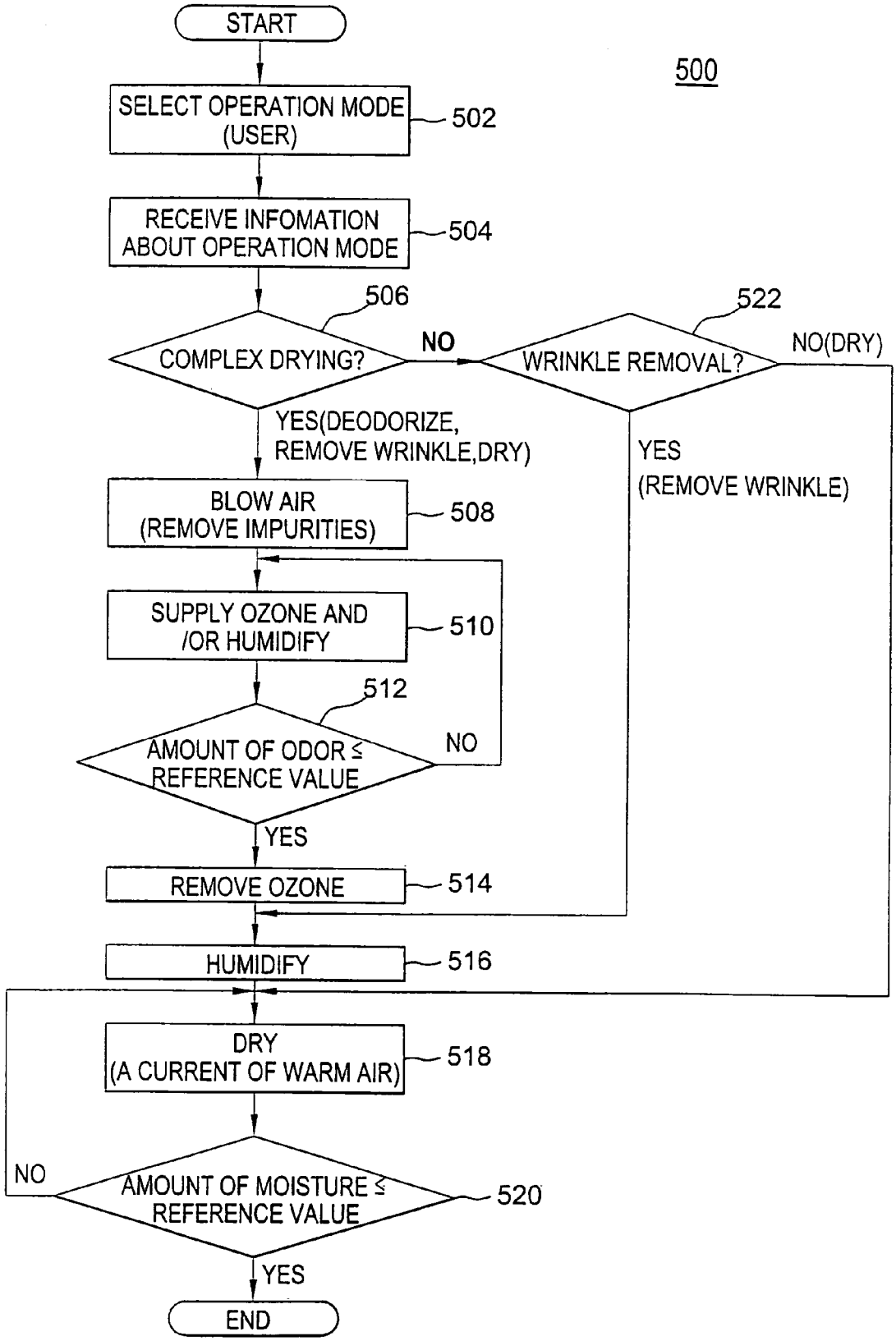

FIGS. 4 and 5 are flow charts showing a method of controlling the clothes dryer of FIG. 1. FIG. 4 illustrates an automatic control method 400, in which at least one of a complex drying function, a wrinkle removing function, and a simple drying function is performed according to conditions of the clothes detected by the humidity sensor 206*a* and the gas sensor 206*b*. FIG. 5 illustrates a manual control method 500, in which at least one of a complex drying function, a wrinkle removing function, and a simple drying function is performed according to an operation mode selected by the user.

As shown in FIG. 4, high-pressure air is blown into the chamber 106 for a relatively short period of time, so that odor and moisture of the clothes spreads throughout the internal space of the chamber 106 in operation 402. Thereafter, the humidity sensor 206*a* and the gas sensor 206*b* detect moisture and odor of the internal air of the chamber 106, respectively, in operation 404.

Which of the complex drying function, wrinkle removing function and simple drying function should be performed is determined by the control unit 202, and is based on detection results of the humidity sensor 206*a* and the gas sensor 206*b*. In other words, the complex drying function, which performs a drying operation, a deodorizing operation, and a wrinkle removing operation, is performed if a detected amount of odor in the internal air of the chamber 106 is larger than an odor reference value (i.e., excessive). The wrinkle removing function is performed if the detected amounts of moisture and odor are equal to or smaller than respective odor and moisture reference values. In contrast, the simple drying function is performed if the detected amount of moisture is larger than the moisture reference value and the detected amount of odor is equal to or smaller than the odor reference value.

In operation 406, if it is determined that the complex drying function is required because the detected amounts of odor inside the chamber 106 are larger than the odor reference value, the high-pressure compressed air is blown once again into the chamber 106 to separate impurities from the clothes in operation 408. The impurities separated from the clothes by the high-pressure compressed air are filtered out by the filter 114 while being drawn through the drawing side of the blower 218.

After the impurities are removed from the clothes, ozone generated by the ozonizer 214 is supplied into the chamber 106 in operation 410. The ozone is used to remove the odor from the chamber 106. Additionally, when the moisture is supplied into the chamber 106 using the humidifier 212, some extent of a deodorization effect may be accomplished.

In operation 412, if the amount of odor inside the chamber 106 detected by the gas sensor 206*b* is equal to or smaller than the odor reference value (i.e., when the odor is sufficiently removed), the ozone disposer 216 removes the ozone inside the chamber 106 in operation 414. If not, then the method 400 returns to operation 410, and ozone and/or humidity are again supplied to the chamber 106.

When the removal of the ozone is completed, the humidifier 212 supplies moisture into the chamber 106 once again in operation 416. The heater 210 then supplies a current of warm air into the chamber 106 in operation 418. The wrinkles of the clothes are removed by heating the clothes containing the moisture using the current of warm air. In operation 420, if the moisture inside the chamber 106 detected by the humidity sensor 206*a* is reduced to a value equal to or smaller than the moisture reference value, the clothes are considered to be sufficiently dried and performance of the complex drying function ends. If, in operation 420, the moisture is greater than the moisture reference value, then the method 400 returns to operation 418.

If, in operation 406, it is determined that complex drying is not required, and if, in operation 422, it is determined that the wrinkle removing function is required, because the detected amounts of moisture and odor inside the chamber 106 are equal to or smaller than the odor and moisture reference values, respectively the wrinkles are removed from the clothes by supplying moisture to the clothes using the humidifier 212 in operation 416. Then, the clothes are dried using the current of warm air generated by the blower 218 in operation 418. In this case, temperature and supplying time of the current of warm air are determined based on the detection result of the humidify sensor 206*a* in operation 420. The control unit 202 controls the blower 218 and the heater 210, so that the determined temperature and supplying time of the current of warm air are met.

If, in operation 422 it is determined that the simple drying function is required, because the detected amount of moisture inside the chamber 106 is larger than the moisture reference value, but the detected amount of odor inside the chamber 106 is equal to or smaller than the odor reference value, then in operation 418, the clothes are dried using the current of warm air.

The manual control method 500 for the clothes dryer of the present invention will be described with reference to FIG. 5 below. As shown in FIG. 5, when a user selects an operation mode to perform one of the complex drying function, the wrinkle removing function, and the simple drying function in operation 502, the control unit 202 receives information about the operation mode selected by the user through the input unit 204, and controls the clothes dryer 100 to perform a corresponding function in operation 504. The complex drying function, wrinkle removing function, and simple drying function that are performed subsequently, are the same as described in conjunction with FIG. 4.

According to one aspect, in the clothes dryer and method of controlling the clothes dryer, the control algorithm of the control unit 202 and the device arrangement are changed so that the clothes dryer is selectively capable of performing the drying and deodorizing function, the drying and wrinkle removing function, the wrinkle removing function, and the drying function.

As apparent from the above description, an embodiment of the present invention provides a clothes dryer and method of controlling the clothes dryer, which are capable of not only drying clothes, but also deodorizing the clothes and removing wrinkles. In addition, an embodiment of the present invention provides a clothes dryer and method of controlling the clothes dryer, which are capable of detecting conditions of clothes accommodated in a chamber, and drying or deodorizing the clothes as occasion demands, so that the clothes may be maintained for a long period.

Although an embodiment of the present invention has been shown and described, it would be appreciated by those skilled in the art that changes might be made in the embodiment without departing from the principles and spirit of the invention, the scope of which is defined in the claims and their equivalents.

What is claimed is:

1. A clothes drying apparatus comprising:

a chamber to accommodate an article of clothing;

a humidifier to selectively supply moisture to the chamber and the article of clothing;

a heater to selectively supply heat to the chamber and the article of clothing;

an ozonizer to selectively supply ozone to the chamber and the article of clothing when an automatically detected odor level of the article of clothing exceeds a reference odor value;

an ozone disposer to selectively remove ozone from air drawn from the chamber;

a blower, communicating with the chamber to circulate an atmosphere of the chamber; and a controller to control the humidifier, the heater, the ozonizer, the ozone disposer, and the blower for selectively deodorizing, drying and removing wrinkles from the article of clothing.

2. The apparatus according to claim 1, wherein:

the ozone disposer is connected to the blower, and is positioned between the blower and the chamber.

3. The apparatus according to claim 1, further comprising:

a filter positioned between the chamber and the blower, to filter impurities separated from an article of clothing in the chamber.

4. The apparatus according to claim 1, wherein the controller further comprises:

a control unit; and a driving unit, wherein the control unit accepts an input, and controls the driving unit to selectively drive the humidifier, the heater, the ozonizer, the ozone disposer, and the blower based on the input.

5. The apparatus according to claim 4, wherein:

the control unit accepts the input from a user.

6. The apparatus according to claim 4, further comprising:

a sensor unit to determine a condition of the chamber, wherein the input is the condition of the chamber, and the control unit accepts the input from the sensor.

7. The apparatus according to claim 6, wherein the sensor unit comprises:

a humidity sensor;

a gas sensor;

a temperature sensor; and an ozone sensor.

8. The apparatus according to claim 7, wherein:

when an article of clothing is placed in the chamber, the sensor unit determines a condition of the article of clothing based on the condition of the chamber, and the control unit controls the driving unit to selectively drive the humidifier, the heater, the ozonizer, the ozone disposer, and the blower based on the condition of the article of clothing, to selectively deodorize, dry, and remove a wrinkle from the article of clothing.

9. The apparatus according to claim 1, further comprising:

a first duct, connected to the blower and positioned in a side wall of the apparatus; and a vent, positioned on the side wall of the apparatus to communicate between the first duct and the chamber, and supply air.

10. The apparatus according to claim 9, further comprising: a second duct connected to the blower and communicating with the chamber to supply air.

11. The apparatus according to claim 10, wherein:

the heater heats air passing through at least one of the first duct and the second duct; and the ozonizer supplies ozone to the chamber through at least one of the first duct and the second duct.

12. The apparatus according to claim 10, wherein:

the first duct is an internal duct; and the second duct is an external duct.

13. The apparatus according to claim 1, further comprising:

a door to selectively open and close the chamber, wherein the door includes a transparent member to observe an internal state of the chamber through the transparent member of the door, while the door is closed.

* * * * *